US007878342B1

(12) United States Patent
Lewis et al.

(10) Patent No.: US 7,878,342 B1
(45) Date of Patent: Feb. 1, 2011

(54) CLOTHESLINES

(76) Inventors: Graham Louis Lewis, 1923 Perodeau, Vaudreuil-Dorion (CA) J7V-8P7; Marc Tremblay, 18029 Poiriau, Pierrefonds (CA) H9K-1J9

( * ) Notice: Subject to any disclaimer, the term of this patent is extended or adjusted under 35 U.S.C. 154(b) by 280 days.

(21) Appl. No.: 12/218,641

(22) Filed: Jul. 17, 2008

Related U.S. Application Data

(60) Provisional application No. 60/963,327, filed on Aug. 3, 2007.

(51) Int. Cl.
*D06F 53/00* (2006.01)

(52) U.S. Cl. ..... 211/119.01; 211/119.13; 211/119.09; 211/119.15; 211/119.02; 242/388.2

(58) Field of Classification Search ..... 242/578, 242/388.2, 388.3, 388.4, 388.6, 118.4; 211/119.01, 211/119.11, 119.12, 119.13, 119.15, 119.09, 211/119.02, 119.03; 254/243
See application file for complete search history.

(56) References Cited

U.S. PATENT DOCUMENTS 291,743 A * 1/1884 Killough ..... 242/388.6
577,754 A * 2/1897 Jackson ..... 242/388.2
881,772 A * 3/1908 Canney ..... 242/388.6
975,811 A * 11/1910 Walsh ..... 211/119.1
1,400,142 A * 12/1921 Cyr ..... 211/119.09
2,607,560 A * 8/1952 Bugg ..... 242/388.3
2,707,091 A * 4/1955 Reeder ..... 248/353
4,519,509 A 5/1985 Doyle
6,454,109 B1 9/2002 Doyle et al.

* cited by examiner

*Primary Examiner*—William A Rivera
(74) *Attorney, Agent, or Firm*—Richard L. Marsh

(57) ABSTRACT

A clothesline system comprises at least two separate cables that are independently tensionable through separate cable tensioning devices. The tension devices are attached together to provide for common, parallel movement of the separate cables though the cables are separately passed around separate pulleys at the both ends of the system. The two separate cables add strength to the system. The separate cables are preferably wound in left and right windings to prevent unraveling of the braid of the cable. By providing separate cables, assembly of the system is less complex as the two loops of cable are separate.

15 Claims, 4 Drawing Sheets

CLOTHESLINES

CROSS REFERENCE TO RELATED APPLICATIONS

This application is a non-provisional application of Applicants' provisional application Ser. No. 60/963,327 filed on 3 Aug. 2007.

BACKGROUND OF THE INVENTION

1. Field of the Invention

This invention relates to a clothesline. Clotheslines are a popular means for drying clothes. In addition to the clothes attaining a fresh outdoors scent, the savings in electricity by not using an electric dryer, can be substantial. Typical clothesline systems provide a support onto which wet clothes are placed to dry. A common clothesline system includes an endless loop cable extending between two pulleys. The cable provides a suitable support on which to hang wet clothes. In order to set clothes onto the cable, clothes are first hung on the clothesline cable and then clothes pins are manually placed onto the clothes. When it is desired to remove the dried clothes from the clothesline cable, the clothes pins must be manually detached and stored.

2. Prior Art Statement

In order to overcome the cumbersome operation of manually applying and removing clothes pins, U.S. Pat. No. 4,519,509 issued May 28, 1985 to Rexford Doyle, suggests a means for automatically applying clothes pins onto clothes when the clothes are displaced away from the user and a means for automatically removing the clothes pins from the dry clothes when the clothes are displaced towards the user. The clothesline system includes an endless first cable extending between two pulleys. A pin lay wheel located between the two pulleys features a V-shaped recess acting to receiving a series of clothes pins in a normally closed position located on a second cable. The ends of the second cable are advantageously attached to the first cable such that when the first cable is displaced away from the user, the second cable is advantageously moved in a cooperative manner with the first cable bringing clothes pins secured on the second cable into engagement with the pin lay wheel. The pins are automatically brought into an opened configuration, releasing from the first cable and allowing them to travel over a substantially arcuate path as defined by the periphery of the lay wheel. Continued rotation of the pin lay wheel causes the pins to re-engage upon a section of the first cable on which wet articles of clothing are placed. As a result, the articles of clothing receive the closing clothes pins become detachably secured onto the first cable. Although the above-mentioned system facilitated the securement of clothes onto the clothesline system, it failed to provide means for preventing the first cable from sagging beyond an acceptable range. More specifically, upon placing clothes onto the first cable, the first cable tended to accordingly pull away from the second cable. In some instances, clothes will pull the first cable sufficiently downwards thus displacing the first cable from the second cable beyond a distance where a clothespin can engage the first cable.

To overcome the problem associated with U.S. Pat. No. 4,519,509, Doyle, et al., U.S. Pat. No. 6,454,109, issued Sep. 24, 2002, provides a clothesline lay-down arm with a first cable support configuration maintaining a preferred distance between a first and second cable at the point of engagement of the wet clothes with the second cable such that the clothespins attach the clothes to the second cable. The closeable clothespins are of unitary construction and provide multiple clothes holding positions as a means of successfully engaging articles of clothing placed over the first cable. Even with the preferred distance provided by the lay-down arm cable support, the weight of wet clothes on the first cable can stretch the first cable to the point that some clothespins will become disengaged from the clothes.

SUMMARY OF THE INVENTION

Though the above patents provide for a workable clothesline, neither device described in U.S. Pat. No. 4,519,509 nor U.S. Pat. No. 6,454,109 address the following issues:

a. Considerable difficulty of installation by a normal person in understanding the cable routing configuration.
b. Unacceptable sag of the cable system when loaded with wet clothes.
c. Uneven stretching of the first and second cables relative to one another other causing the clothes pins to cant unacceptably.
d. Tension in the first cable can cause the first cable to partially unravel and twist. The twisting first cable causes the clothes pins and cable assembly to corkscrew in a spiral manner rendering the clothesline system either unusable or more difficult to use.

Thus, there is thus a need in the industry to provide a clothesline system that resolves the aforementioned issues and therefore, one object of this invention is to provide a clothes line system comprising at least two separate cables wherein the cables are independently tensionable.

A primary goal of this invention is to provide a clothes line system comprising at least two separate cables wherein the cables have separate cable tensioning devices wherein the tension devices are attached together to provide for common, parallel movement of the separate cables.

A significant feature of this invention is to provide a clothes line system comprising at least two separate cables wherein the cables are separately passed around separate pulleys at the remote end of the system.

A main purpose of this invention is to provide a clothes line system comprising at least two separate cables wherein the separate cables are wound in left and right windings to prevent unraveling of the braid of the cable.

A principal aim of this invention is to provide a clothes line system comprising at least two separate cables wherein the two cables add strength to the system.

A primary aspect of this invention is to provide a clothes line system comprising at least two separate cables wherein the assembly of the system is less complex as the two loops of cable are separate.

Another object of this invention is to provide a tensioning system that eliminates a Y connector which tended to strip off the vinyl covering from the cable.

DESCRIPTION OF THE PREFERRED EMBODIMENTS

While the various features of this invention are hereinafter described and illustrated as a common clothesline system comprising at least two endless loop cables extending between separate pairs of pulleys wherein the cables have separate tensioning mechanisms, it is to be understood that the various features of this invention can be used singly or in various combinations thereof to provide a clothesline system operable in an endless loop as can hereinafter be appreciated from a reading of the following description.

Figure 1:
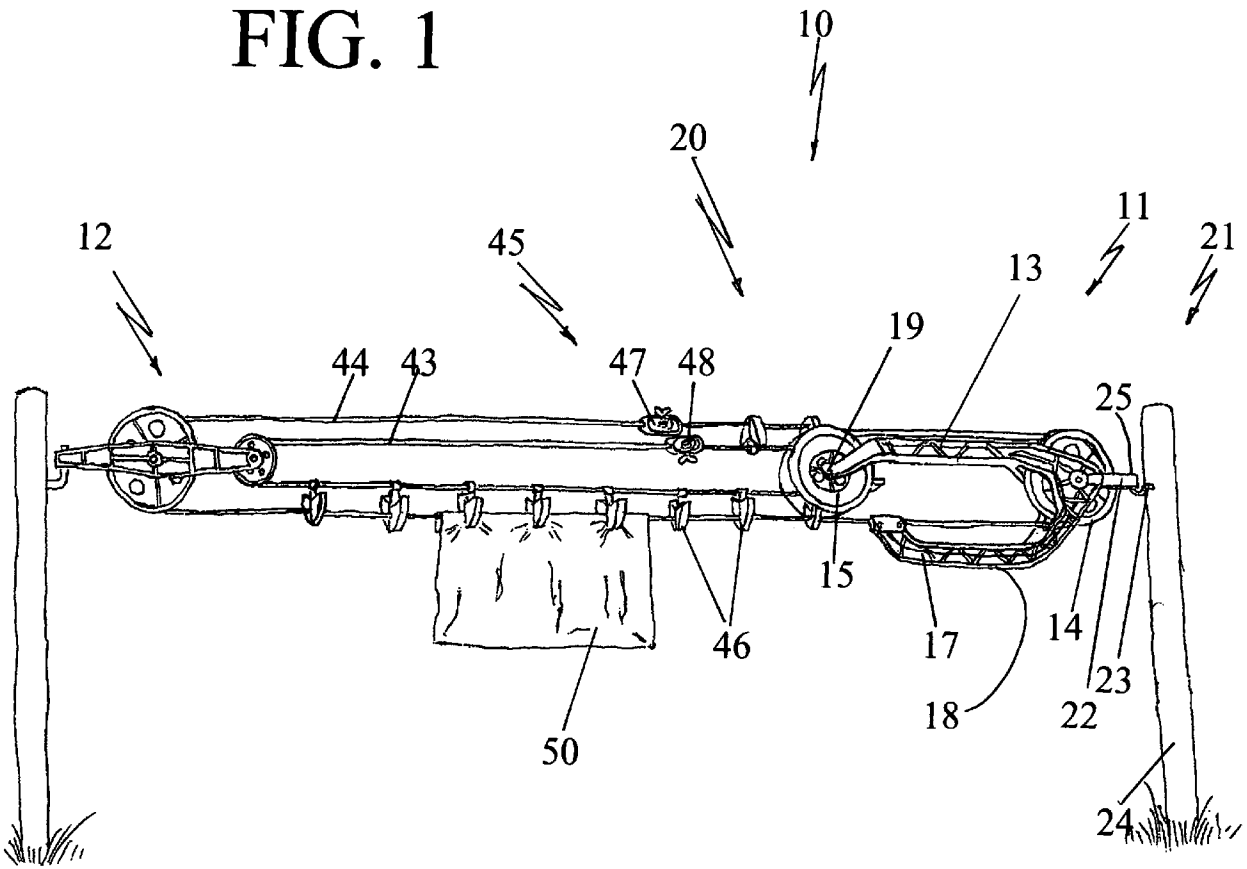
FIG. 1 is a perspective view of the preferred embodiment of the clothesline system of this invention.
Figure 3:
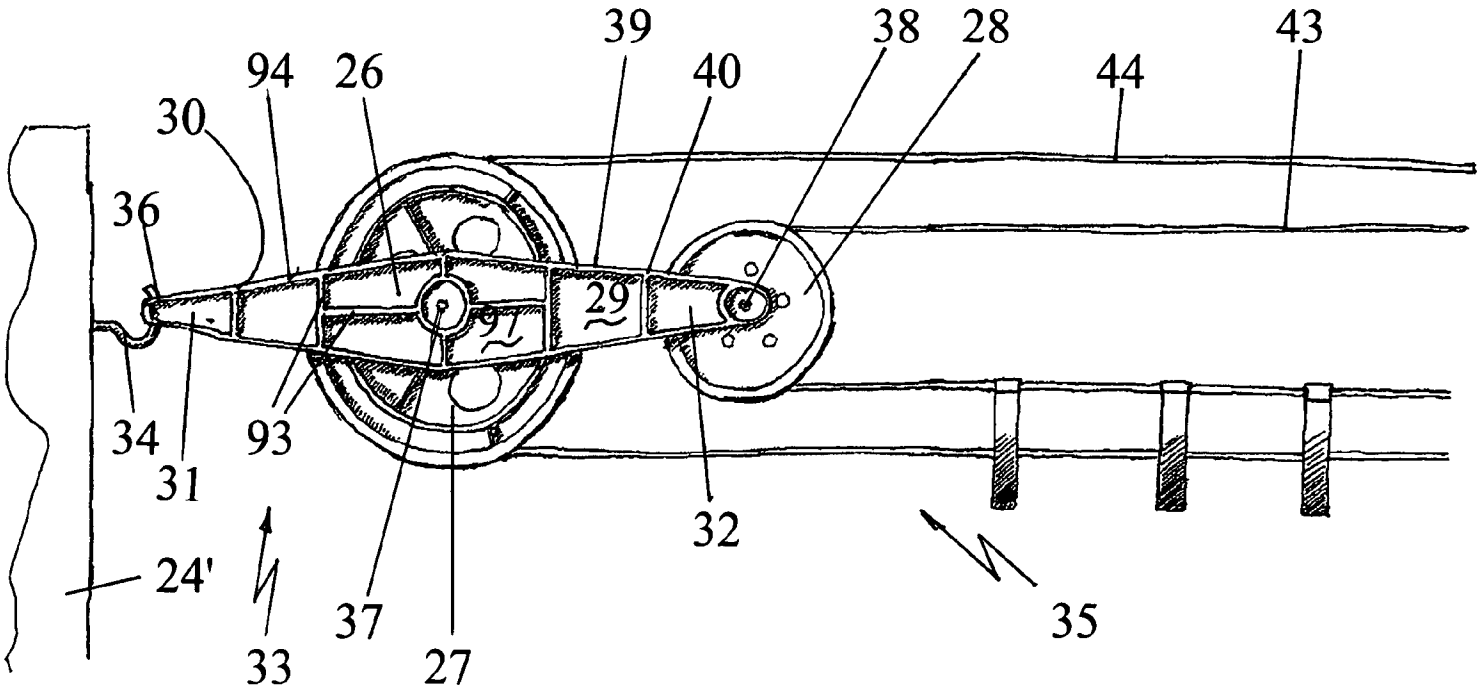
FIG. 3 is an enlarged side plan view of the remote end of the preferred embodiment showing separate pulleys for the separate cables mounted to a common bracket.
Figure 4:
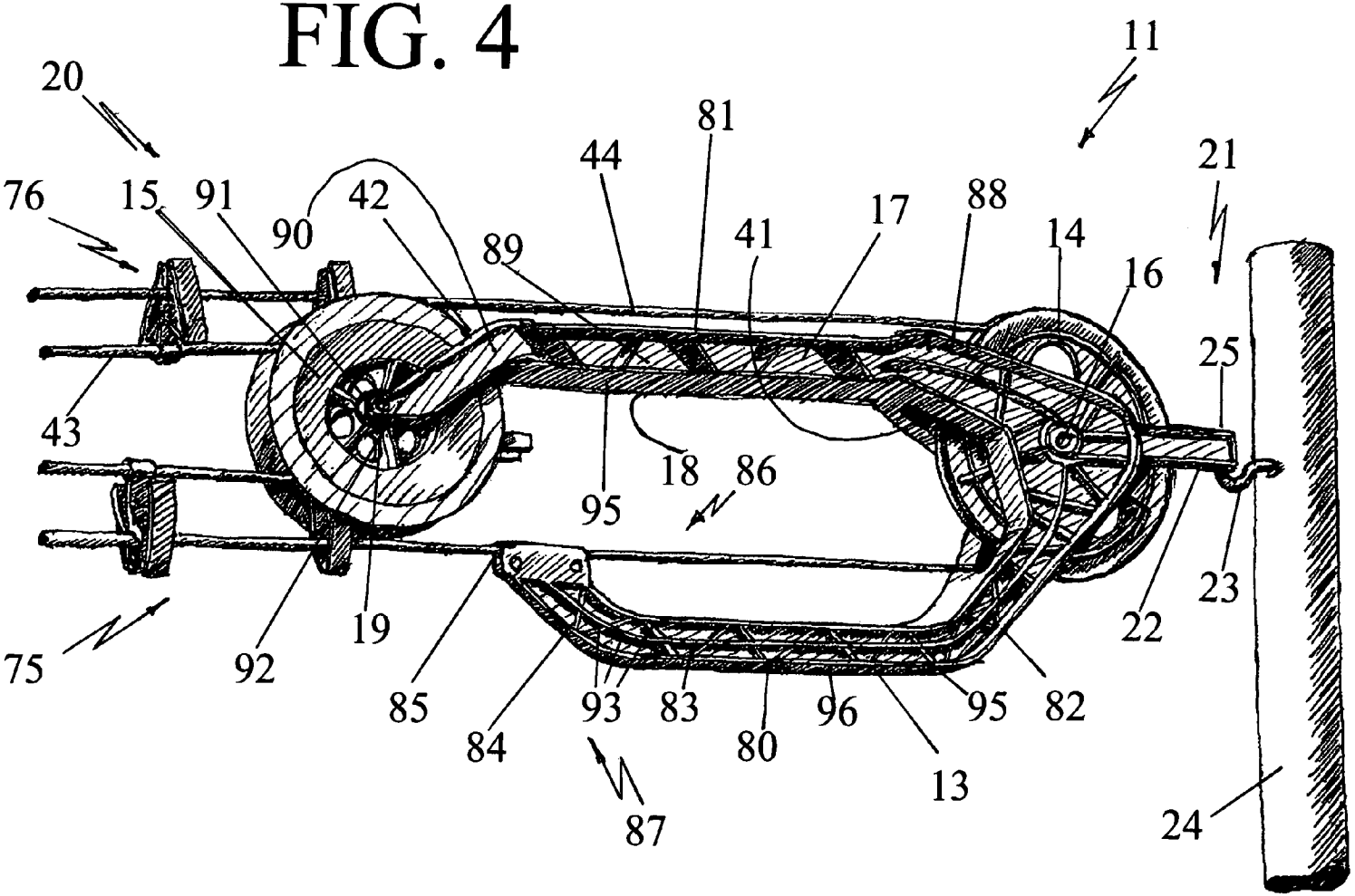
FIG. 4 is an enlarged perspective view of the loading end of an alternate embodiment showing a straight section between a primary cable pulley and a pin lay pulley.

Referring now to FIG. 1, the clothesline system of the instant invention is generally depicted with the numeral 10 and comprises a remote end 12, a loading end 11, a pair of cables 43, 44 separately disposed around remote end 12 and loading end 11, a tensioning mechanism 45 and a plurality of clothespins 46. Loading end 11 is substantially identical to the loading end as described in U.S. Pat. No. 6,454,109, the entire disclosure thereof incorporated into this invention by this reference thereto though an alternate, reduced height loading end yoke 13 for loading end 11 is shown in FIG. 4, to be hereinafter described more fully. Referring to both FIG. 1 and FIG. 4, loading end yoke 13 carries a primary cable pulley 14 and a pin lay pulley 15, primary cable pulley 14 rotatable on an axle 16 disposed through side walls 17, 18 of yoke 13 and pin lay pulley 15 disposed on an axle 19 disposed through side walls 17, 18 of yoke 13 at a free end 20 of yoke 13 remote from a hanging end 21 of yoke 13. Hanging end 21 is provided with an arm 22 extending from yoke 13, arm 22 provided with an aperture 25 disposed vertically therethrough between side walls 17, 18 for receiving a mounting hook 23 therein. Mounting hook 23 may be affixed to a stand alone pole 24 or to a side of a building such as a window frame of an apartment building (not shown) as is well known. Referring also to FIG. 3, remote end 12 also comprises a yoke 26 carrying a primary cable pulley 27 and a pin cable pulley 28, primary pulley cable pulley 27 of larger diameter than pin cable pulley 28. Yoke 26 has side walls 29, 30, an arm 31 on one end 33 of yoke 26 and an arm 32 on an end 35 opposite end 33, arm 31 provided with an aperture 36 therethrough between side walls 29, 30 for receiving a remote mounting hook 34 therethrough, remote mounting hook 34 affixed to another stand alone pole or to a side of a building 24'. Primary cable pulley 27 of remote end 12 is rotatable on an axle 37 and pin cable return pulley 28 is separately rotatable on an axle 38 in arm 32, axles 37, 38 journaled in side walls 29, 30. Yoke 26 has at least one slot 39 disposed between side walls 29, for receiving primary cable pulley 27 and pin cable return pulley 28 therein. Preferably, a separate slot 40 is provided for pin cable return pulley 28 to provide further strength to yoke 26. Similarly, a slot 41 is provided in yoke 13 for primary cable pulley 14 and a separate slot 42 is provided in free end 20 of yoke 13, separate slots 41, 42 also provided to enhance strength of yoke 13.

Figure 2:
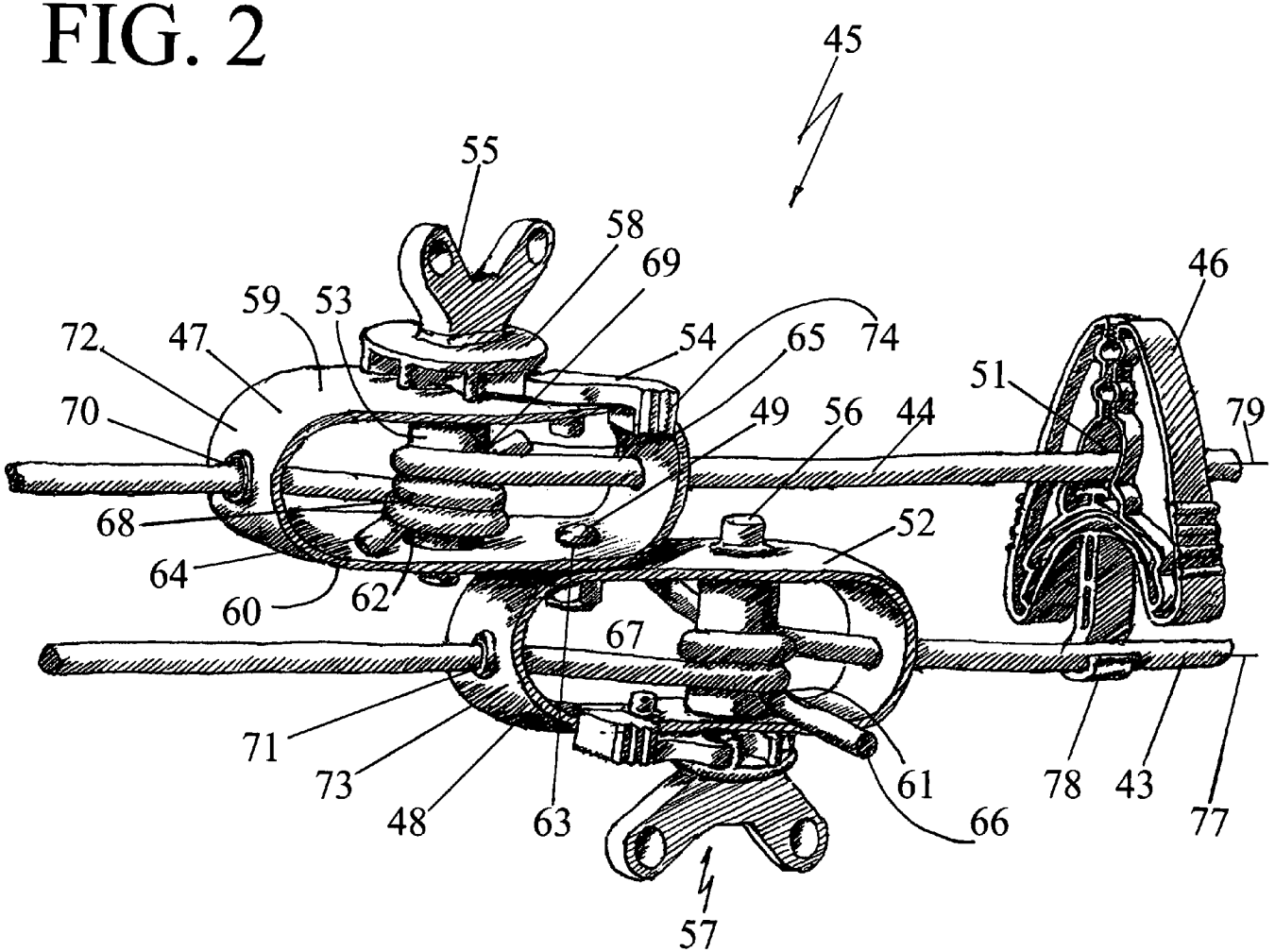
FIG. 2 is an enlarged perspective view of the cable tensioning mechanism of the preferred embodiment showing separate cable tensioning devices joined together for simultaneous translation.

While continuing to refer to FIG. 1, clothesline system 10 has tensioning mechanism 45, best shown in FIG. 2, to greatly reduce sag in cable 43 when loaded with wetted clothes, to provide for support to cable 43 through tensioning mechanism 45 and to provide for separate tensioning of cables 43, 44. Tension may be added to either, or both, cables 43, 44 as desired by the user. Tensioning mechanism 45 comprises a pair of identical tensioning devices 47, 48 for separately providing tension to pin carrying cable 43 and primary cable 44, tensioning devices 47, 48 joined together with a fastener 49, fastener 49 disposed through a connection hole 63 in touching side walls 60 of an oval band 52 of tensioning devices 47, 48. Fastener 49 transfers some load of pin carrying cable 43 to primary cable 44, though primary cable 44 also carries a primary portion of the load of clothes 50 pinned to clothespins 46 as clothes 50 are directly pinned to primary cable 44 by pinching clothes 50 against primary cable 44 in closeable apertures 51 disposed in clothespins 46 as is described in the aforementioned U.S. Pat. No. 6,454,109. In the instant invention, tensioning devices 47, 48 are substantially identical, but disposed in an inverted, mirror image relationship for mating together with fastener 49, tensioning devices 47, 48 each comprising an oval band 52, a spindle 53, a ratchet 54, a turnkey 57 and a cap nut 56. Turnkey 57 is an unitary unit comprising an axle (not shown), a lock gear 58 and a key 55, the axle extending from lock gear 58 through a journal bore 61 disposed through a first side wall 59 of oval band 52, through a bore of spindle 53, through a journal bore 62 disposed through a second side wall 60 of oval band 52 and is retained in oval band 52 by cap nut 56. Turnkey 57 is rotatable within journal bores 61, 62 and is affixed to spindle 53 with splines, keys, mating polygonal surfaces or any other means known to provide for rotational joinder of a spindle and an axle. Spindle 53 may further be provided with at least one anchor hole 69 therethrough for receiving one end 64-67 of cables 43, 44 therein to affix cable ends 64-67 to spindle 53. Preferably, spindle 53 has two anchor holes 69, 68 disposed therethrough, spindle 53 of tensioning device 47 receiving ends 64, 65 of primary cable 44 therein and spindle 53 of tensioning device 48 receiving ends 66, 67 of pin carrying cable 43 therein. Oval band 52 also is provided with cable holes 70, 71 bored through the bights 72, 73 of oval band 52, cable holes 70, 71 adapted to receive ends 64-67 of cables 43, 44 therethrough for insertion into anchor holes 68, 69 in spindle 53. In order to allow for tensioning of cable 44, for instance, ends 64, 65 of cable 44 are first passed through cable holes 70, 71 respectively, of tensioning unit 47, ends 64, 65 are then passed through anchor holes 68, 69 respectively, in spindle 53 and key 55 is rotated to wind cable 44 about spindle 53. Key 55 is rotated sufficiently to overlap ends 64, 65 of cable 44 over spindle 53 to retain cable 44 thereupon, key 55 rotated until a required tension is applied to cable 44. Ratchet 54, biased into constant engagement with lock gear 58 thus retains the wound tension in cable 44. In a like manner, ends 66, 67 of cable 43 are passed through cable holes 70, 71 of tensioning device 48, positioned in anchor holes 68, 69 in spindle 53 and key 55 turned until cable 43 is properly tensioned. Relief of tension from cables 43 or 44 is accomplished by depressing thumb latch 74 though it is advisable to hold and turn key 55 in a tensioning direction while simultaneously depressing thumb latch 74. It is readily apparent here that cables 43, 44 may be tensioned separately thus overcoming a primary deficiency in the prior art devices.

Still referring to FIG. 4, tensioning devices 47, 48 are joined together in at least one place, preferably at hole 63 with fastener 49. Separate tensioning devices 47, 48 thus become unitary tensioning mechanism 45 when joined thus ensuring that cable 43 is translated at the same speed as cable 44. Therefore, either cable 43 or 44 may be rotated while laying clothes upon cable 43 or upon taking clothes from cable 43. As cables 43, 44 are caused to translate at the same rate because cables 43 and 44 are joined by tensioning mechanism 45, canting of clothespins 46 is eliminated, frictional markings are eliminated from clothes 50, tearing of clothing is eliminated and clothespins 46 remain attached to cable 43.

Referring now to FIGS. 1-3, cables 43, 44 preferably travel in parallel paths such that as clothespins 46 are presented to pin lay pulley 15 from either clothesline end 75 or storage end 76, clothespins 46 enter pin lay pulley 15 in a vertical manner and straight away such that canting or cocking of clothespins 46 is prevented. In order to accomplish the parallel paths of cables 43, 44, cable 44 travels over one pair of pulleys 14, 27 while cable 43 traverses a path over separate, smaller pulleys 15, 28. The pitch line diameter of pulleys 14, 27 is greater than the pitch line diameter of pulleys 15, 28 by twice the distance from a centerline 77 of a line clip 78 of clothespin 46 to a centerline 79 of cloth grip aperture 51 provided in clothespin 46. Pin lay pulley 15 may also be provided with slots at the interior periphery thereof to accommodate line clip 78 though the difference in effective pitch diameter of pin lay pulley 15 is negligible without the slots at the interior periphery. It is unnecessary to provide slots in the interior periphery of pulley 28 if so provided in pin lay pulley 15, as clothespins 46 do not rotate through pulley 28 though it is cost efficient to produce pulleys 15 and 28 as identical entities, both for interchangeability at assembly and stocking inventory. Likewise, pulleys 14, 27 are manufactured as identical items substantially for the same reasons.

Yoke 13 comprises two distinct arms, a lower support arm 80 and an upper support arm 81. Lower support arm 80 includes three continuous segments substantially as described in U.S. Pat. No. 6,454,109, namely a first oblique segment 82 which extends downward from axle 16 carrying pulley 14 connecting with a horizontal intermediate segment 83 extending parallel to and below cable 44 and a final oblique segment 84 that extends upward toward pin lay pulley 15 but terminates below and short of pin lay pulley 15. As in U.S. Pat. No. 6,454,109 a guide 85 is provided at an extreme end 87 of final segment 84 to receive cable 44 and support cable 44 adjacent, and preferably, tangent to pulley 14. Guide 85 includes mating components fastened together through which cable 44 can slide freely. In effect, lower support arm 80 provides support along a span 86 of cable 44 on which clothes 50 may be freely placed. Upper support arm 81 also includes three continuous segments; a first oblique segment 88 extending upwardly from axle 16 beyond pulley 14 but terminating below cable 44, a horizontal segment 89 and a final oblique segment 90 extending downwardly from horizontal segment 89 terminating in an axle housing 91 beyond guide 85. Final segment 90 of upper support arm 81 is a fork 92 that supports pin lay pulley 15. Fork 92 carries axle housing 91 in its spaced apart members, each with an axle bore disposed therethrough which receive axle 16 to rotatably support pin lay wheel 15. Thus, upper support arm 81 of this instant invention differs from prior art support arms as upper support arm 81 no longer carries cable 44 in guides to present cable 44 to pin lay wheel 15 as cable 44 is separate from, yet parallel to, cable 43. Thus, cable 44 is payed off primary cable pulley 14 directly in line with apertures 51 in clothespins 46. Accordingly a simpler manufacturing process for loading end yoke 13 is provided as well as a simpler assembly of clothesline system 10.

One method of assembly of said clothesline system 10 comprises the steps of inserting primary cable pulley 27 in position between opposed sides 29, 30 of remote end yoke 26 at a location of axle 37 and inserting axle 37 through either side 29 or 30, through primary cable pulley 27 and finally through the opposed side 30 or 29. Either side 29 or 30 may be adapted to receive axle 37 in a press fit relationship, however, preferably axle 37 receives cap nuts on both opposed ends thereof. Likewise, pin cable pulley 28 is inserted between opposed sides 29, 30 with axle 38 disposed through sides 29, 30 and pin cable pulley 28 to secure pin cable pulley 28 to remote end yoke 26. Axle 38 may also be press fit into either of sides 29, 30 or receive cap nuts on either or both ends thereof. Loading end yoke 13 is also assembled in a similar manner with primary cable pulley 14 inserted into yoke 13 adjacent hanging end 21 with axle 16 rotatably affixing primary cable pulley 14 to yoke 13 by disposing axle 16 through side wall 17, primary cable pulley 14 and side wall 18. As with axles 37, 38 in remote end yoke 26, axle 16 is preferably secured to loading end yoke 13 with cap nuts on the ends thereof, however, axle 16 may also be press fit into at least one side wall 17, 18. Pin opening pulley 15 is assembled to loading end yoke 13 at free end 20 in a similar manner and rotatably secured therein with axle 19 disposed through side walls 17, 18. Pin carrying cable 44 is then preferably trained around pulley 15 of loading end yoke 13 by passing one end 66 or 67 through pin slot 42 and training the selected end 66, 67 through slot 40 and around pin cable pulley 28 in remote end yoke 26. Tensioning device 48 then receives ends 66, 67 through cable holes 70, 71 in oval band 52, through anchor holes 68, 69 in spindle 53 whereupon key 55 of tensioning device 48 is rotated sufficiently to overlap at least ends 66, 67 with a layer of cable 44. In a similar manner, one end 64, 65 of primary cable 43 is trained around primary cable pulley 14 in loading end yoke 13, carefully inserted into guide 85 in extreme end 87 of oblique segment 84 and trained around primary cable pulley 27 in remote end yoke 26 whereupon ends 64, 65 are disposed through cable holes 70, 71 in oval band 52 and through anchor holes 68, 69 in spindle 53 of tensioning device 47, key 55 of tensioning device 47 also rotated sufficiently to secure ends 64, 65 to tensioning device 47. Upon assembly of cables 43, 44 to loading end yoke 13 and remote end yoke 26, loading end yoke 13 has aperture 25 preferably secured to a mounting hook 23 on a stand alone pole 24 or the side 24' of a building and remote end yoke 26 likewise has aperture 36 disposed on remote mounting hook 34 on another stand alone pole 24 or a side 24' of an opposed building at a distance from loading end yoke 13. Once yokes 13, 26 are secured to hooks 23, 34, cables 43, 44 may be loosened from spindles 53 of tensioning devices 47, 48 and pulled through anchor holes 68, 69 to provide an initial length to system 10. Key 55 in each of tensioning devices 47, 48 is then rotated to provide an initial tension to cables 43, 44 whereupon at least one end 64-67 of cables 43, 44 is cut and key 55 in tensioning devices 47, 48 is rotated until a proper tension is achieved in cables 43, 44. Clothespins 46 may then be spaced along pin cable 43 at spaced distances by clipping line clip 78 to pin cable 43.

Loading end yoke 13 and remote end yoke 26 are preferably molded from thermoplastic materials which may include reinforced thermoplastics, thermoplastic elastomers or combinations thereof, however, yokes 13, 26 may also be manufactured from wood or metals without departing from the scope of this invention. Preferably, yokes 13, 26 are of I-beam cross section with reinforcing braces 93 supporting the flanges 94, 95 of yokes 26, 13 respectively. By providing reinforcing braces 93, yokes 13, 26 are made as strong as possible while reducing the mass thereof. It is, though, fully within the scope of this invention to manufacture yokes 13, 26 of solid construction, with smooth side surfaces 96 of side walls 17, 18 and smooth side surfaces 97 of side walls 29, 30 in order to provide for ease of wiping off surfaces 96, 97 prior to loading clothes 50 thereupon. Thus, yokes 13, 26 may be tubular, solid with mass reducing holes disposed longitudinally therethrough or of expanded thermoplastic material having internally generated closed cells.

Preferably, cables 43, 44 are elastomeric coated stranded steel cables, however, it is within the scope of this invention to provide cables 43, 44 of hemp, textiles, elastomeric materials, uncoated steel cable or combinations of the above in braided, woven, twisted or straight strands or combinations thereof. Preferably, cables 43, 44 are comprised of a plurality of small diameter wound steel cable strands, each cable strand wound in a first hand, such as counterclockwise, and the plurality of strands wound in an opposite hand, ie., clockwise prior to coating cable 43, 44 with an elastomeric substance. By winding the strands of cables 43, 44 in opposite hand to the final cable structure, stability is provided to cable 43, 44 to essentially eliminate twisting of cable 43, or 44 during operation of clothesline system 10 further allowing straight and vertical entrance of clothespins 46 to pin lay pulley 15.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the invention and should not be construed to be the only variants thereof nor limited thereto.

We claim:

1. A clothes line system comprises at least two separate movable cables, a loading end yoke, a return yoke, a plurality of tensioning devices and a plurality of pulleys wherein one said cable carries a plurality of removable clothespins disposed thereupon, said cables independently tensionable, said one cable independently looped around two of said plurality of pulleys of a given diameter and another said cable independently looped around two of said plurality of pulleys of a diameter greater than said given diameter wherein said one cable has opposed ends thereof affixed to a spindle of a first tensioning device and said other cable has opposed ends thereof affixed to a spindle of a second tensioning device said independent cables joined together by said tensioning devices wherein said cables are movable as a unitary unit.

2. A clothesline system as in claim 1 wherein said first tensioning device is affixed to said second tensioning device.

3. A clothesline system as in claim 1 wherein said one cable is disposed within peripheral bounds of said second cable.

4. A clothesline system comprises separate movable cables, a loading end yoke, a return yoke, a plurality of pulleys, a plurality of clothespins and at least one tensioning device wherein said cables have separate cable tensioning devices, said tensioning devices disposed in mirror image relationship and attached together to provide for common, parallel movement of said separate cables wherein said tensioning devices each comprise a closed oval band, a spindle, a ratchet, a turnkey and a cap nut wherein said turnkey further comprises an axle, a lock gear and a key, said axle extending from said lock gear through a journal bore disposed through a first side wall of said oval band, through a bore of said spindle, through a journal bore disposed through a second side wall of said oval band, said axle retained in said oval band by said cap nut.

5. A clothesline system as in claim 4 wherein said spindles of said tensioning devices have at least one anchor hole disposed therethrough for receiving opposed ends of said cables therein.

6. A clothesline system as in claim 5 wherein said oval band has cable holes disposed through said oval band, said cable holes approximately aligned with a major axis of said oval band.

7. A clothesline system as in claim 6 wherein one cable end of a first cable is disposed through one said cable hole and through one said anchor hole in said spindle.

8. A clothesline system as in claim 7 wherein an opposed cable end of said first cable is disposed through an opposed cable hole in said oval band and through said one anchor hole in said spindle.

9. A clothesline system as in claim 7 wherein an opposed cable end of said first cable is disposed through an opposed cable hole in said oval band and through another said hole in said spindle.

10. A clothesline system as in claim 4 wherein said tensioning devices are joined together with a fastener disposed through common connection holes in touching side walls of said oval bands of said tensioning devices.

11. A clothes line system comprises two movable cables, a loading end yoke, a return yoke, a plurality of pulleys, a plurality of clothespins and at least two tensioning devices, said plurality of pulleys comprising one pair of pulleys of a given diameter and a second pair of pulleys of a larger diameter, one said cable separately passed around said pulleys of said given diameter and another said cable separately passed around said pulleys of larger diameter at a remote end of said system, said separate cables joined together by said tensioning devices wherein said cables are movable as an unitary unit.

12. A clothesline system as in claim 11 wherein said return yoke is disposed at said remote end of said system, said return yoke having an aperture at one end for affixing said yoke to separate structure, an axle disposed laterally through said yoke at an opposite end thereof and an axle disposed laterally through said yoke intermediate said one end and said opposite end.

13. A clothesline system as in claim 12 wherein said yoke has an elongated slot disposed between said axles for receiving said clothespins therethrough.

14. A clothesline system as in claim 13 wherein said axle at said opposite end has one said pulley disposed thereupon, said pulley receiving one said movable cable therearound.

15. A clothesline system as in claim 13 wherein said axle intermediate said one end and said opposite end has a larger one of said pulleys disposed thereupon, said larger pulley receiving another said movable cable therearound.

* * * * *